US009378884B2

(12) United States Patent
Kim et al.

(10) Patent No.: US 9,378,884 B2
(45) Date of Patent: Jun. 28, 2016

(54) MULTILAYER ELECTRONIC COMPONENT AND METHOD OF MANUFACTURING THE SAME

(71) Applicant: SAMSUNG ELECTRO-MECHANICS CO., LTD., Suwon-Si, Gyeonggi-Do (KR)

(72) Inventors: Ic Seob Kim, Suwon-si (KR); Ho Yoon Kim, Suwon-si (KR); Myeong Gi Kim, Suwon-si (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 19 days.

(21) Appl. No.: 14/201,379

(22) Filed: Mar. 7, 2014

(65) Prior Publication Data

US 2015/0162124 A1 Jun. 11, 2015

(30) Foreign Application Priority Data

Dec. 5, 2013 (KR) ..... 10-2013-0150823

(51) Int. Cl.

| | |
|---|---|
| ***H01F 5/00*** | (2006.01) |
| ***H01F 27/28*** | (2006.01) |
| ***H01F 41/00*** | (2006.01) |
| ***H01F 27/24*** | (2006.01) |
| ***H01F 27/00*** | (2006.01) |
| ***H01F 17/00*** | (2006.01) |

(Continued)

(52) U.S. Cl.

CPC ..... *H01F 27/2804* (2013.01); *H01F 5/00* (2013.01); *H01F 17/0013* (2013.01); *H01F 17/04* (2013.01); *H01F 27/00* (2013.01); *H01F 27/24* (2013.01); *H01F 41/005* (2013.01); *H01F 41/046* (2013.01); *H01F 2027/2809* (2013.01); *Y10T 29/4902* (2015.01)

(58) Field of Classification Search

CPC ..... H01F 5/00; H01F 27/00–27/30
USPC ..... 336/65, 83, 200, 233–234
See application file for complete search history.

(56) References Cited

U.S. PATENT DOCUMENTS

| | | | | |
|---|---|---|---|---|
| 7,839,651 | B2 * | 11/2010 | Nishizawa | H01F 17/0006 361/761 |
| 2001/0031690 | A1 * | 10/2001 | Chikagawa | C03C 8/14 501/32 |
| 2004/0070903 | A1 * | 4/2004 | Nagai | H01G 4/30 361/58 |

(Continued)

FOREIGN PATENT DOCUMENTS

| | | | |
|---|---|---|---|
| JP | 2005-203723 | A | 7/2005 |
| JP | 2007027354 | A | 2/2007 |

(Continued)

OTHER PUBLICATIONS

Notice of Office Action Korean Patent Application No. 10-2013-0150823 dated Nov. 4, 2014 with full English translation.

*Primary Examiner* — Tuyen Nguyen
(74) *Attorney, Agent, or Firm* — McDermott Will & Emery LLP

(57) ABSTRACT

There are provided a multilayer electronic component and a method of manufacturing the same. More particularly, there are provided a multilayer electronic component capable of maintaining high inductance at a high frequency due to excellent magnetic properties and having excellent DC bias properties and a dense fine structure to thereby improve strength, and a method of manufacturing the same.

13 Claims, 6 Drawing Sheets

(51) Int. Cl.
*H01F 17/04* (2006.01)
*H01F 41/04* (2006.01)

(56) References Cited

U.S. PATENT DOCUMENTS

2009/0061178 A1* 3/2009 Sugimoto ..... C03C 14/004 428/210
2014/0145816 A1 5/2014 Sato et al.

FOREIGN PATENT DOCUMENTS

JP 2010-118587 A 5/2010
JP 2013045926 A 3/2013
KR 1020070100491 A 10/2007
KR 10-2013-0126723 A 11/2013

* cited by examiner

A

B

MULTILAYER ELECTRONIC COMPONENT AND METHOD OF MANUFACTURING THE SAME

CROSS-REFERENCE TO RELATED APPLICATION

This application claims the benefit of Korean Patent Application No. 10-2013-0150823 filed on Dec. 5, 2013, with the Korean Intellectual Property Office, the disclosure of which is incorporated herein by reference.

BACKGROUND

The present disclosure relates to a multilayer electronic component and a method of manufacturing the same, and more particularly, to a multilayer electronic component having excellent magnetic properties and improved strength, and a method of manufacturing the same.

Among electronic components, inductors, important passive devices for configuring electronic circuits, together with resistors and capacitors, are used to remove noise or as components configuring LC resonance circuits, and the like.

Passive devices such as power inductors, and the like, used in smartphones, mobile information technology (IT) devices, and the like, operate in a relatively high frequency band of 1 MHz or above. Therefore, a soft magnetic material prepared by mixing, calcining, and grinding a plurality of metal oxides known as soft magnetic ferrites, for example, $Fe_2O_3$, NiO, CuO, ZnO, or the like, has commonly been used.

However, recently, with increasing use of smartphones, mobile IT devices, and the like, data transmission amounts have increased significantly, switching frequencies of central processing units (CPU) have increased to allow for high speed data processing, and power usage amounts in mobile devices, and the like, have rapidly increased due to smartphone screens having relatively large areas, high resolutions, and the like. Due to the increase in power usage in the mobile devices, passive devices such as power inductors, and the like, injected in plural, in a driving circuit design such as that of CPUs, display units, power management modules, and the like, should have high power consumption efficiency.

According to demands for improving the efficiency of power inductors, and the like, as described above, power inductors capable of operating in a high frequency band of 1 MHz or above by replacing a soft magnetic ferrite material with a fine metal powder and having improved energy consumption efficiency and direct current bias properties by significantly decreasing eddy current loss, or the like, have been produced as products.

According to the related art, as an inductor to which metal powder is applied, there exist thin film inductors and winding inductors.

The thin film inductor is manufactured by winding copper wire on a board such as a printed circuit board (PCB), or the like, through a plating method, by press-molding a metal-epoxy mixed material in which metal powder and an epoxy resin are mixed with each other so as to enclose the copper wire, and performing a curing process on the epoxy resin by heat-treatment.

The winding inductor is manufactured by winding a copper wire, sealing the wound copper wire using a composite material in which a metal and an epoxy are mixed with each other, press-molding the sealed copper wire in a mold at a high pressure to obtain a chip, and then curing the epoxy by heat-treatment.

The inductors manufactured by two methods as described above have significantly excellent DC bias properties as compared to a ferrite multilayer inductor, and as a result obtained by evaluating properties of a power management integrated circuit (PMIC) module set, or the like, efficiency is improved by several percent or more.

As described above, a metal magnetic sheet multilayer inductor has been studied in order to simultaneously secure mass production possibility in addition to advantages that the DC bias properties and efficiency of the inductor, or the like, are improved due to the application of metal powder. The metal magnetic sheet multilayer inductor may be manufactured by forming a uniform mixture of metal powder and a polymer as a sheet, instead of an oxide ferrite sheet, and performing a series of processes such as a via hole punching process, an internal conductor printing process, a stacking process, a sintering process, and the like, on the metal magnetic sheet.

In the metal magnetic sheet multilayer inductor, DC bias properties may be exhibited similarly to those in the thin film or winding inductor; however, since a metal material having physical properties of being oxidized at the time of heat-treatment is used, there is a limitation in a sintering temperature condition of a chip. For example, an oxide layer may be formed on a surface of the metal powder during a sintering process of a metal sheet multilayer body, and a production amount of this oxide layer on surfaces of metal particles may be adjusted by controlling a sintering temperature. The oxide layer serves to suppress insulation breakdown from being generated due to electric connections between the metal particles or between the metal particles and internal electrodes and to impart chip strength by generating bonds between metal particle oxide layers.

However, since bonding force between the metal particle oxide layers is relatively weak and a metal particle filling rate is insufficient, it is difficult to secure sufficient chip strength, and thus, chip breakdown, or the like, may be generated at the time of mounting.

A multilayer electronic component manufactured by stacking and sintering a magnetic layer formed of a paste containing a metal magnetic material and a glass ingredient and a conductive pattern is disclosed in Patent Document 1.

However, in the multilayer electronic component disclosed in Patent Document 1, the glass ingredient may be partially concentrated during a heat-treating process, and the addition of the glass ingredient may be problematic in terms of filling the metal magnetic material during a compressing process before heat-treatment. Such disadvantage in the filling of the metal magnetic material may result in a decrease in permeability, or the like, and a limitation in exhibiting inductance properties as an inductor device.

RELATED ART DOCUMENT (Patent Document 1) Japanese Patent Laid-open Publication No. 2007-027354

SUMMARY

An aspect of the present disclosure may provide a multilayer electronic component capable of maintaining high inductance at a high frequency due to excellent magnetic properties and having excellent DC bias properties and improved strength, and a method of manufacturing the same.

According to an aspect of the present disclosure, a multilayer electronic component may include: a metal magnetic body in which a plurality of metal magnetic layers are stacked; and an internal conductive pattern part formed inside the metal magnetic body, wherein the metal magnetic body includes a glass absorption part formed at an outermost portion thereof.

The glass absorption part may be formed in upper and lower cover layers and a margin part inside the metal magnetic body.

A thickness of the glass absorption part formed in each of the upper and lower cover layers from a surface of the metal magnetic body may be 30% to 80% of a thickness of each of the upper and lower cover layers.

A thickness of the glass absorption part formed in the margin part from a surface of the metal magnetic body may be 30% to 80% of a thickness of the margin part.

The glass absorption part may contain glass formed of at least one selected from a group consisting of $SiO_2$, $B_2O_3$, $V_2O_5$, CaO, $Al_2O_3$, $TiO_2$, $ZrO_2$, $K_2O$, and $Li_2O$.

In an overall composition of glass contained in the glass absorption part, a content of at least one selected from a group consisting of $SiO_2$, $B_2O_3$ and $V_2O_5$ may be 60 mol % or more.

A metal filling rate of the glass absorption part may be 70 vol % or more.

The metal magnetic body may contain metal magnetic particles formed of an alloy containing at least one selected from a group consisting of Fe, Si, Cr, Al, and Ni.

The multilayer electronic component may further include a glass insulation layer on a surface of the metal magnetic body.

According to another aspect of the present disclosure, a multilayer electronic component may include: a metal magnetic body in which a plurality of metal magnetic layers are stacked; and an internal conductive pattern part formed inside the metal magnetic body, wherein an outermost portion of the metal magnetic body may be filled by a dense layer containing glass and having a metal filling rate increased by 10 vol % or more as compared to a central portion of the metal magnetic body.

A thickness of the dense layer formed in the outermost portion of the metal magnetic body from a surface of the metal magnetic body may be 30% to 80% of a thickness of each of upper and lower cover layers.

A thickness of the dense layer formed in the outermost portion of the metal magnetic body from a surface of the metal magnetic body may be 30% to 80% of a thickness of a margin part.

A metal filling rate of the dense layer may be 70 vol % or more.

According to another aspect of the present disclosure, a method of manufacturing a multilayer electronic component may include: preparing a plurality of metal magnetic sheets; forming conductive patterns on the metal magnetic sheets; stacking and sintering the metal magnetic sheets on which the conductive patterns are formed to form a metal magnetic body; coating a surface of the metal magnetic body with a glass solution; and heat-treating the glass coated metal magnetic body to form a glass absorption part at an outermost portion inside the metal magnetic body.

The glass solution may contain 5 wt % to 20 wt % of glass.

The glass coated metal magnetic body may contain 1.0 wt % to 4.0 wt % of glass.

The glass coated metal magnetic body may be heat-treated at 600° C. to 750° C.

The glass absorption part may be formed so that a thickness of the glass absorption part from a surface of the metal magnetic body is 30% to 80% of a thickness of each of upper and lower cover layers and a margin part.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
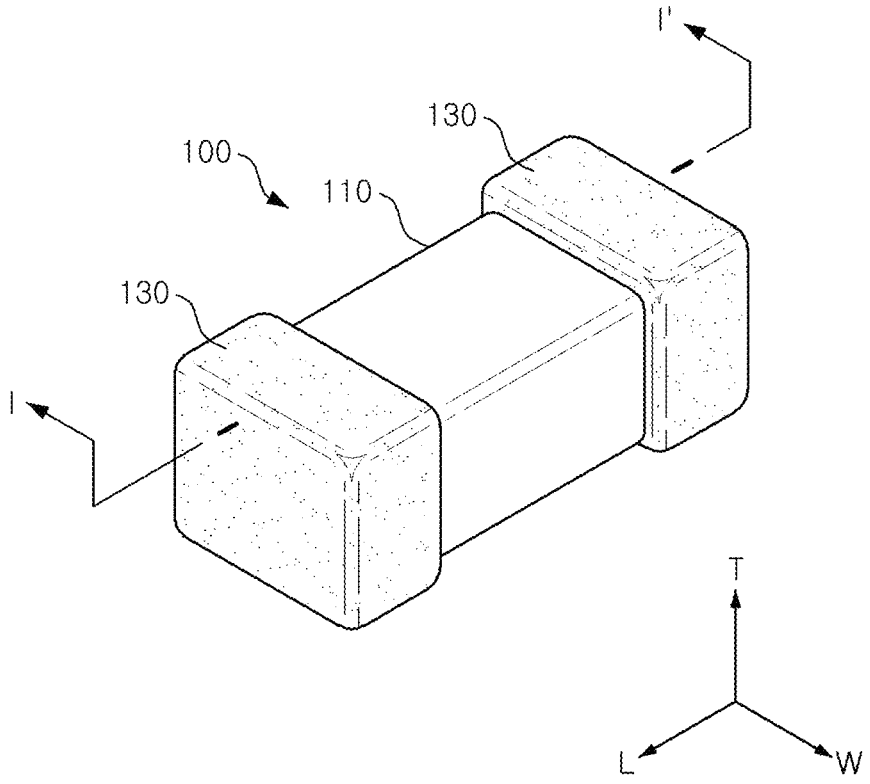
FIG. 1 is a perspective view of a multilayer electronic component according to an exemplary embodiment of the present disclosure.

Exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Directions of a hexahedron will be defined in order to clearly describe the exemplary embodiments of the present disclosure. L, W and T shown in the accompanying drawings refer to a length direction, a width direction, and a thickness direction, respectively. Here, the thickness direction may be the same as a direction in which magnetic layers are stacked.

Multilayer Electronic Component

Hereinafter, a multilayer electronic component according to an exemplary embodiment of the present disclosure will be described. Here, a multilayer inductor will be described by way of example, but the present disclosure is not limited thereto.

Figure 2:
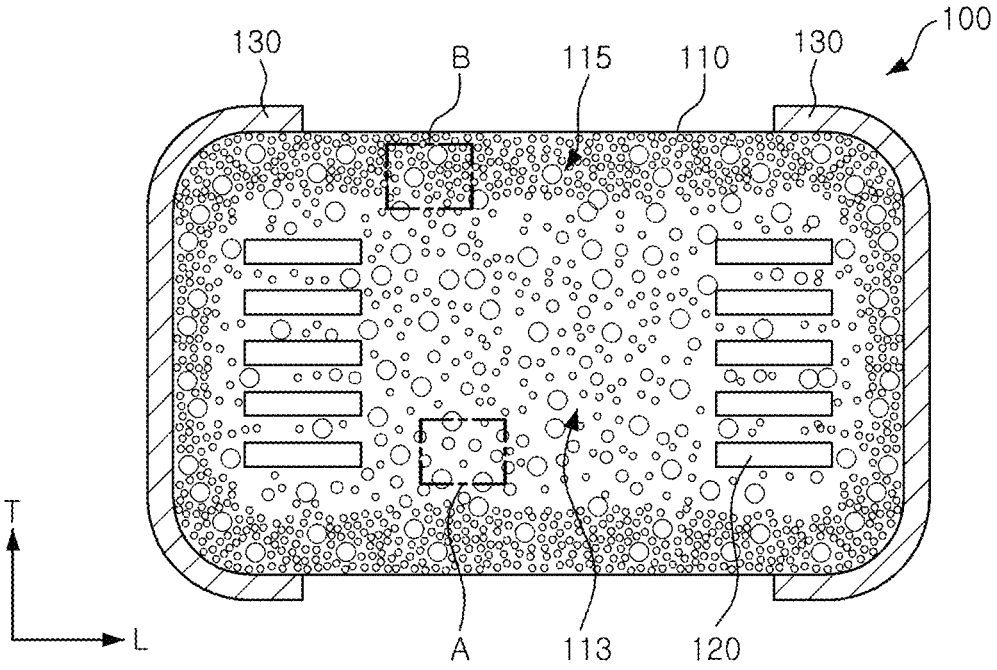
FIG. 2 is a cross-sectional view taken along line I-I' of FIG. 1.
Figure 3:
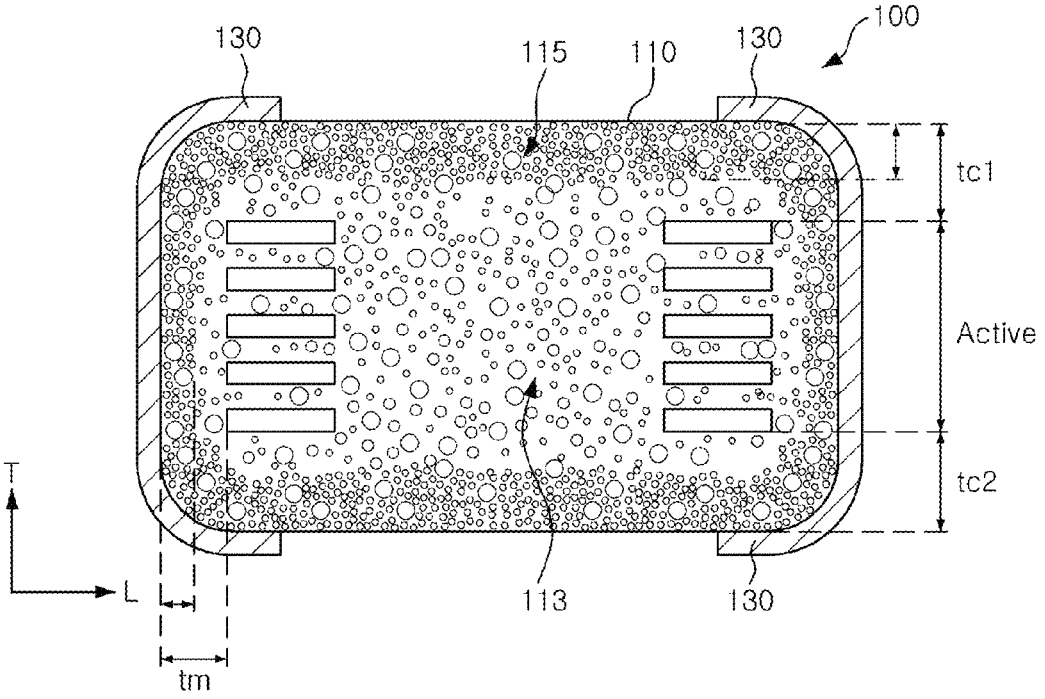
FIG. 3 is a cross-sectional view of a multilayer electronic component according to an exemplary embodiment of the present disclosure.
Figure 4:
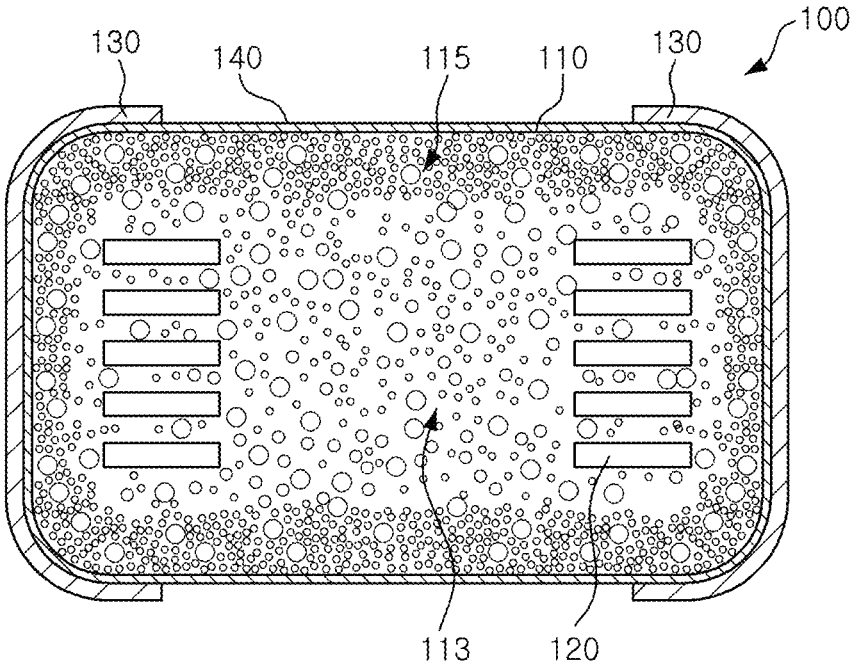
FIG. 4 is a cross-sectional view of a multilayer electronic component according to an exemplary embodiment of the present disclosure.

FIG. 1 is a perspective view of a multilayer electronic component according to an exemplary embodiment of the present disclosure, FIG. 2 is a cross-sectional view taken along line I-I' of FIG. 1, and FIGS. 3 and 4 are cross-sectional views of multilayer electronic components according to other exemplary embodiments of the present disclosure.

Referring to FIGS. 1 through 4, a multilayer electronic component 100 according to an exemplary embodiment of the present disclosure may include a metal magnetic body 110 formed by stacking a plurality of metal magnetic layers, an internal conductive pattern part 120 formed in the metal magnetic body, and external electrodes 130 formed on both end surfaces of the metal magnetic body 110 to be electrically connected to both ends of the internal conductive pattern part 120, wherein the metal magnetic body 110 may include a glass absorption part 115 formed at an outermost portion inside the metal magnetic body 110.

The metal magnetic body 110 may be formed as a hexahedron having both end surfaces in the length (L) direction, both side surfaces in the width (W) direction, and both main surfaces in the thickness (T) direction. The metal magnetic body 110 may be formed by stacking the plurality of metal magnetic layers in the thickness (T) direction and then sintering the stacked metal magnetic layers. In this case, a shape and a dimension of the metal magnetic body 110 and the number of stacked metal magnetic layers are not limited to those of this exemplary embodiment shown in the accompanying drawings.

The plurality of metal magnetic layers configuring the metal magnetic body 110 may be in a sintered state. Adjacent metal magnetic layers may be integrated such that boundaries therebetween are not readily apparent without using a scanning electron microscope (SEM).

The sintered metal magnetic body 110 may contain metal magnetic particles whose surfaces are coated with oxide films. The metal magnetic particle may be formed of a soft magnetic alloy, for example, an alloy containing at least one selected from a group consisting of Fe, Si, Cr, Al, and Ni, and more preferably, a Fe—Si—Cr based alloy, but is not limited thereto.

The internal conductive pattern part 120 may be formed by printing a conductive paste containing a conductive metal on the plurality of metal magnetic layers stacked in the thickness (T) direction at a predetermined thickness, and the conductive metal is not particularly limited as long as it has excellent electric conductivity. For example, silver (Ag), palladium (Pd), aluminum (Al), nickel (Ni), titanium (Ti), gold (Au), copper (Cu), platinum (Pt), or the like, may be used alone, or a mixture thereof may be used.

A via may be formed at a predetermined position in each metal conductive layer on which an internal conductive pattern is printed. The internal conductive patterns formed in the individual metal conductive layers may be electrically connected to each other through the vias to form a single coil.

The metal magnetic body 110 may be configured of an active part including the internal conductive pattern part 120 formed therein and upper and lower cover layers formed on upper and lower surfaces of the active part, wherein the active part contributes to forming inductance. In addition, margin parts in which the internal conductive pattern part 120 is not formed may be formed at end portions of the metal magnetic body 110 in the length (L) direction and in the width (W) direction.

The glass absorption part 115 may be formed at the outermost portion inside the metal magnetic body 110, wherein the outermost portion refers to a portion inside the metal magnetic body 110 between the surface of the metal magnetic body 110 and a portion positioned inwardly from the surface of the metal magnetic body 110 by a predetermined depth. For example, the glass absorption part 115 may be formed in the upper and lower cover layers and the margin part of the metal magnetic body 110.

The glass absorption part 115 may be formed by coating the surface of the metal magnetic body 110 with a glass solution and performing heat-treatment thereon to allow glass to be absorbed in the outermost portion of the metal magnetic body 110. Due to a flow of the absorbed glass liquid, metal magnetic particles of the glass absorption part 115 may be partially rearranged, such that intervals between the particles may be decreased, and the glass may partially fill open pores between the metal magnetic particles to form a denser structure, thereby improving strength.

The glass absorption parts 115 formed in the upper and lower cover layers of the metal magnetic body 110 may be formed so that thicknesses of the glass absorption parts 115 from the surfaces of the metal magnetic body 110 are 30% to 80% of thicknesses tc1 and tc2 of the upper and lower cover layers.

As the glass deeply infiltrates to thereby increase a region of the glass absorption part 115, the strength of the metal magnetic body 110 may be further improved; however, as a heat-treatment time for deeply infiltrating the glass liquid into the chip is increased, the metal particles in the metal magnetic body may be additionally oxidized, such that inductance may be decreased. Therefore, it is important to form the glass absorption part 115 so as to improve strength while maintaining excellent inductance, efficiency, and the like.

In the case in which the glass absorption parts 115 are formed to have thicknesses less than 30% of the respective thicknesses tc1 and tc2 of the upper and lower cover layers, the strength improvement may be insignificant, such that the chip may be broken. In the case in which the glass absorption parts 115 are formed to have thicknesses more than 80% thereof, the metal magnetic material may be additionally oxidized, such that the inductance may be significantly decreased.

In addition, the glass absorption part 115 formed in the margin part of the metal magnetic body 110 may be formed so that a thickness of the glass absorption part 115 from the surface of the metal magnetic body 110 is 30 to 80% of a thickness tm of the margin part.

In the case in which the glass absorption part 115 is formed to have a thickness less than 30% of the thickness tm of the margin part, the strength improvement may be insignificant, such that the chip may be broken. In the case in which the thickness of the glass absorption part 115 is more than 80% thereof, the metal magnetic material may be additionally oxidized, such that the inductance may be significantly decreased.

The glass contained in the glass absorption part 115 may contain glass formed of any one selected from a group consisting of $SiO_2$, $B_2O_3$, $V_2O_5$, CaO, $Al_2O_3$, $TiO_2$, $ZrO_2$, $K_2O$, and $Li_2O$. In this case, it may be advantageous in view of improving strength that a content of a network forming element configuring a backbone structure of the glass is 60 mol % or more. An example of the network forming element may include $SiO_2$, $B_2O_3$, $V_2O_5$, or the like.

In the glass absorption part 115, the metal magnetic particles may be partially rearranged by the flow of the absorbed glass liquid, such that intervals between the metal magnetic particles may be decreased, and the glass may partially fill the open pores between the metal magnetic particles to form a denser structure. Therefore, a metal filling rate of the glass absorption part 115 may be 70 vol % or more.

The outermost portion of the metal magnetic body 110 including the glass absorption part 115 may be denser than a central portion 113 thereof, and a metal filling rate thereof is improved by 10 vol % or more as compared to that of the central portion 113.

Figure 5:
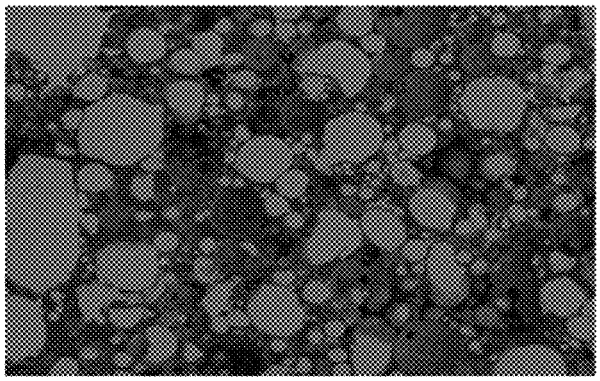
FIG. 5 is photographs obtained by observing fine structures of parts A and B of FIG. 2 using a scanning electron microscope (SEM)
Figure 5:
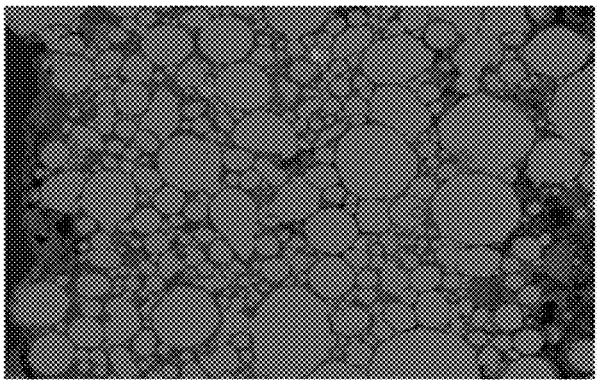

FIG. 5 is photographs obtained by observing fine structures of parts A and B of FIG. 2 using a scanning electron microscope (SEM).

Referring to FIG. 5, it may be confirmed that a metal filling rate is significantly improved and a dense structure is shown in part B corresponding to the glass absorption part 115, as compared to part A corresponding to the central portion 113 into which the glass is not absorbed.

Since the metal magnetic body 110 is configured of the central portion into which the glass is not absorbed and the outermost portion into which the glass is absorbed to thereby form the dense layer having the metal filling rate increased by 10 vol % or more, a high inductance value may be obtained, and the strength of the metal magnetic body 110 may be significantly improved.

A glass insulation layer 140 may be formed on the surface of the metal magnetic body 110. The glass insulation layer 140 may be formed on the surface of the metal magnetic body 110 at a thickness of 5 μm or less, and glass contained in the glass insulation layer 140 may contain glass formed of at least one selected from a group consisting of $SiO_2$, $B_2O_3$, $V_2O_5$, CaO, $Al_2O_3$, $TiO_2$, $ZrO_2$, $K_2O$, and $Li_2O$.

The oxide films may be formed on the surfaces of the metal magnetic particles forming the metal magnetic body 110 to thereby insulate the metal magnetic particles from each other. However, in the case in which the oxide films are not appropriately formed or a surface of the chip is damaged, an electric short-circuit may be generated by exposed metal magnetic particles, and defects such as plating spread, or the like, may be generated. Therefore, the glass insulation layer 140 is formed on the surface of the metal magnetic body 110, such that the electric short-circuit and plating spread may be prevented.

The external electrodes 130 may be formed on at least one end surface of the metal magnetic body 110 and formed of the same conductive material as that of the internal conductive pattern part 120, but is not limited thereto. For example, as the conductive material, copper (Cu), silver (Ag), nickel (Ni), or the like, may be used alone, or a mixture thereof may be used. The internal conductive pattern part 120 may be electrically connected to the external electrodes 130, and in the case of forming the glass insulation layer 140, portions of the internal conductive pattern part 120 may penetrate through the glass insulation layer 140 to thereby be electrically connected to the external electrodes 130.

Method of Manufacturing Multilayer Electronic Component

Figure 6:
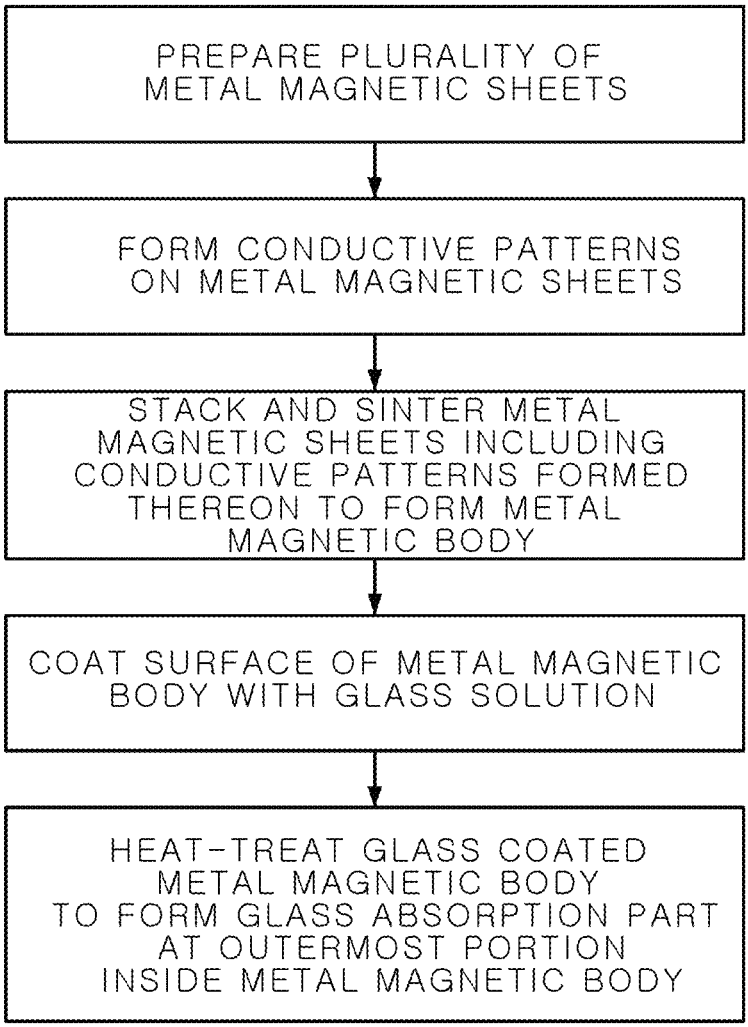
FIG. 6 is a flowchart showing a method of manufacturing a multilayer electronic component according to an exemplary embodiment of the present disclosure.

FIG. 6 is a flowchart showing a method of manufacturing a multilayer electronic component according to an exemplary embodiment of the present disclosure.

Referring to FIG. 6, firstly, a plurality of metal magnetic sheets may be prepared by applying slurry formed by mixing metal magnetic particles and an organic material to carrier films and drying the same.

The metal magnetic particles may be formed of a soft magnetic alloy, for example, an alloy containing at least one selected from a group consisting of Fe, Si, Cr, Al, and Ni, and more preferably, a Fe—Si—Cr based alloy, but is not limited thereto.

The metal magnetic sheets may be manufactured by mixing the metal magnetic particles, a binder, and a solvent to prepare the slurry and forming the prepared slurry as sheets having a thickness of several μm by a doctor blade method.

Next, a conductive paste containing a conductive metal powder may be prepared. The conductive metal powder is not particularly limited as long as it has excellent electric conductivity. For example, silver (Ag), palladium (Pd), aluminum (Al), nickel (Ni), titanium (Ti), gold (Au), copper (Cu), platinum (Pt), or the like, may be used alone, or a mixture thereof may be used.

Internal conductive patterns may be formed by applying the conductive paste to the metal magnetic sheets using a printing method, or the like. As a printing method of the conductive paste, a screen printing method, a gravure printing method, or the like, may be used, but the present disclosure is not limited thereto.

A via may be formed at a predetermined position in each of the metal conductive layers on which the internal conductive patterns are printed, and the internal conductive patterns formed in the metal conductive layers may be electrically connected to each other through the vias to form a single coil.

The metal magnetic sheets on which the internal conductive patterns are printed may be stacked to form an active part, and the metal magnetic sheets having no internal conductive pattern may be stacked on upper and lower surfaces of the active part, and then, they are pressed and sintered to thereby form a metal magnetic body.

Next, a surface of the metal magnetic body may be coated with a glass solution.

The glass solution may be formed by mixing a glass powder, a polymer binder, and an organic solvent such as ethanol, or the like.

The glass powder may be prepared by cooling and grinding a melt after preparing a powder mixture containing at least one selected from a group consisting of $SiO_2$, $B_2O_3$, $V_2O_5$, CaO, $Al_2O_3$, $TiO_2$, $ZrO_2$, $K_2O$, and $Li_2O$ through a hot-melting process and needs to have chemical resistance in order not to be dissolved in the organic solvent.

In this case, it may be advantageous in view of improving strength that a content of a network forming element forming a backbone structure of the glass is 60 mol % or more. An example of the network forming element may include $SiO_2$, $B_2O_3$, $V_2O_5$, or the like.

A content of the glass coated on the surface of the metal magnetic body may be adjusted according to a content of the glass powder contained in the glass solution and the number of coating and may be 1.0 wt % to 4.0 wt %. To this end, a glass solution containing 5 wt % to 20 wt % of glass powder may be used, and the number of coating may be adjusted. In the case in which the content of the glass coated on the surface of the metal magnetic body is less than 1.0 wt %, an amount of glass absorbed in the metal magnetic body may be small, such that it may be difficult to form a dense layer. In the case in which the content of the glass is more than 4.0 wt %, the metal magnetic particles may be additionally oxidized due to an excessive amount of glass liquid, such that inductance may be decreased, and spots caused by lumping of glass partially crystallized on a surface of a chip, or the like, may be formed, thereby generating a chip appearance defect.

In order to coat the surface of the metal magnetic body with the glass, the glass solution may be applied by a spray injection method, or a method of impregnating the metal magnetic body into the glass solution and then taking the metal magnetic body out may be repeatedly performed several times.

Thereafter, the metal magnetic body coated with the glass may be heat-treated, such that a glass absorption part may be formed in an outermost portion of the metal magnetic body.

The surface of the metal magnetic body is coated with the glass and heat-treated at a temperature equal to or higher than a temperature at which the glass powder exhibits a viscous flow behavior, such that the glass powder may flow while having a predetermined viscosity to rearrange the metal magnetic particles and fill open pores between the metal magnetic particles, thereby forming the glass absorption part having a dense fine structure.

In this case, the heat-treatment temperature may be 600° C. to 750° C. In the case in which the heat-treatment temperature is less than 600° C., the glass powder does not have the viscose flow behavior, and thus, an absorption depth of the glass powder absorbed in the metal magnetic body may not be easily controlled. In the case in which the heat-treatment temperature is higher than 750° C., the metal magnetic particles may be additionally oxidized, such that inductance may be decreased.

A heat-treatment time is not particularly limited, but the surface of the metal magnetic body may be maintained at the heat-treatment temperature for 10 to 30 minutes so that the glass absorption part may be formed in the outermost portion of the metal magnetic body.

Meanwhile, in the heat-treating process after the glass coating, organic materials remaining in the glass coating layer such as the polymer binder in the glass solution may leave carbon residues or be changed into gas such as carbon dioxide, or the like, to form bubbles, or the like, at the time of heat-treatment, thereby deteriorating quality. Therefore, the manufacturing method may further include de-binding the organic binder approximately at a decomposition temperature of the organic binder, which is lower than the heat-treatment temperature.

At the time of allowing the glass to be absorbed into the outermost portion of the metal magnetic body, a thickness of the glass absorption part to be formed may be adjusted by controlling the content of the coated glass, the heat-treatment temperature and time, and the like. As the glass deeply infiltrates to thereby increase a region of the glass absorption part, the strength of the chip may be further improved; however, as the heat-treatment time for deeply infiltrating the glass liquid into the chip is increased, the metal particles in the metal magnetic body may be additionally oxidized, and thus, inductance may be decreased. Therefore, it is important to form the glass absorption part so as to improve strength while maintaining excellent inductance, efficiency, and the like.

The glass absorption parts formed in upper and lower cover layers of the metal magnetic body may be adjusted so that thicknesses of the glass absorption parts from the surface of the metal magnetic body are 30% to 80% of the thicknesses tc1 and tc2 of the upper and lower cover layers, respectively.

Further, the glass absorption part formed in a margin part of the metal magnetic body may be adjusted so that the thickness of the glass absorption part from the surface of the metal magnetic body is 30% to 80% of the thickness tm of the margin part.

A glass insulation layer may be formed on the surface of the metal magnetic body. A portion of the glass coated on the metal magnetic body may form the glass insulation layer on the surface of the metal magnetic body at a thickness of 5 μm or less, but the present disclosure is not limited thereto.

The metal magnetic body including the glass absorption part formed by heat-treatment may be polished, such that a lumping region of devitrificated and crystallized glass remaining on the surface may be removed. Then, the polished metal magnetic body may be washed and dried, and external electrodes may be formed thereon by applying and sintering a conductive material. The external electrodes may be formed of one of copper (Cu), silver (Ag), and nickel (Ni) or a mixture thereof, and a tin (Sn) or nickel (Ni) plating layer may be formed on the external electrodes.

The metal magnetic body is coated with the glass and then heat-treated. Even when there are defects such as delamination between layers of the metal magnetic sheet multilayer body, cracks, or the like, a defect portion may be complemented due to infiltration of the glass liquid, and sufficient strength capable of blocking chip breakdown during post-processing such as a chip polishing process, a plating process, an external electrode printing process, an electrode sintering process, and the like, may be secured.

As set forth above, a multilayer electronic component according to exemplary embodiments of the present disclosure may maintain high inductance at a high frequency due to excellent magnetic properties, have excellent DC bias properties, and have a dense fine structure to thereby improve strength.

While exemplary embodiments have been shown and described above, it will be apparent to those skilled in the art that modifications and variations could be made without departing from the spirit and scope of the present disclosure as defined by the appended claims.

What is claimed is:

1. A multilayer electronic component comprising:

a metal magnetic body in which a plurality of metal magnetic layers are stacked; and an internal conductive pattern part formed inside the metal magnetic body, wherein the metal magnetic body includes a glass absorption part formed at an outermost portion thereof, wherein the glass absorption part includes metal magnetic particles and glass filled open pores between the metal magnetic particles.

2. The multilayer electronic component of claim 1, wherein the glass absorption part is formed in upper and lower cover layers and a margin part inside the metal magnetic body.

3. The multilayer electronic component of claim 2, wherein a thickness of the glass absorption part formed in each of the upper and lower cover layers from a surface of the metal magnetic body is 30% to 80% of a thickness of each of the upper and lower cover layers.

4. The multilayer electronic component of claim 2, wherein a thickness of the glass absorption part formed in the margin part from a surface of the metal magnetic body is 30% to 80% of a thickness of the margin part.

5. The multilayer electronic component of claim 1, wherein the glass absorption part contains glass formed of at least one selected from a group consisting of $SiO_2$, $B_2O_3$, $V_2O_5$, CaO, $Al_2O_3$, $TiO_2$, $ZrO_2$, $K_2O$, and $Li_2O$.

6. The multilayer electronic component of claim 1, wherein in an overall composition of the glass contained in the glass absorption part, a content of at least one selected from a group consisting of $SiO_2$, $B_2O_3$ and $V_2O_5$ is 60 mol % or more.

7. The multilayer electronic component of claim 1, wherein a metal filling rate of the glass absorption part is 70 vol % or more.

8. The multilayer electronic component of claim 1, wherein the metal magnetic body contains metal magnetic particles formed of an alloy containing at least one selected from a group consisting of Fe, Si, Cr, Al, and Ni.

9. The multilayer electronic component of claim 1, further comprising a glass insulation layer on a surface of the metal magnetic body.

10. A multilayer electronic component comprising:

a metal magnetic body in which a plurality of metal magnetic layers are stacked; and an internal conductive pattern part formed inside the metal magnetic body, wherein an outermost portion of the metal magnetic body is filled by a dense layer containing glass and having a metal filling rate increased by 10 vol % or more as compared to a central portion of the metal magnetic body.

11. The multilayer electronic component of claim 10, wherein a thickness of the dense layer formed in the outermost portion of the metal magnetic body from a surface of the metal magnetic body is 30% to 80% of a thickness of each of upper and lower cover layers.

12. The multilayer electronic component of claim 10, wherein a thickness of the dense layer formed in the outermost portion of the metal magnetic body from a surface of the metal magnetic body is 30% to 80% of a thickness of a margin part.

13. The multilayer electronic component of claim 10, wherein a metal filling rate of the dense layer is 70 vol % or more.

* * * * *